US006921347B1

(12) United States Patent
Morrow et al.

(10) Patent No.: US 6,921,347 B1
(45) Date of Patent: Jul. 26, 2005

(54) LACROSSE GOALIE STICK HEAD

(75) Inventors: David Morrow, Farmington Hills, MI (US); Jesse Hubbard, Troy, MI (US); Salvatore LoCascio, Bayport, NY (US)

(73) Assignee: Warrior Lacrosse, Inc., Warren, MI (US)

( * ) Notice: Subject to any disclaimer, the term of this patent is extended or adjusted under 35 U.S.C. 154(b) by 705 days.

(21) Appl. No.: 09/837,826

(22) Filed: Apr. 18, 2001

Related U.S. Application Data

(60) Provisional application No. 60/197,720, filed on Aug. 14, 2000.

(51) Int. Cl.[7] ..... A63B 59/02; A63B 65/12
(52) U.S. Cl. ..... 473/513; D21/724
(58) Field of Search ..... 473/505, 510, 473/512–513, 516, 524, 527, 528, 511; D21/724, D21/723, 722, 698

(56) References Cited

U.S. PATENT DOCUMENTS

| | | | |
|---|---|---|---|
| 346,751 | A | 8/1886 | Hillman |
| 364,596 | A | 6/1887 | Luce |
| 891,813 | A | 6/1908 | Ceel |
| 1,459,389 | A | 6/1923 | Brown |
| 1,877,820 | A | 8/1932 | Costello |
| 2,039,138 | A | 4/1936 | Auer |
| 2,142,527 | A | 1/1939 | Pool |
| 2,508,519 | A | 5/1950 | Jay |
| 2,596,894 | A | 5/1952 | Frisch |
| 3,086,777 | A | 4/1963 | Lacoste |
| 3,473,806 | A | 10/1969 | Patterson |
| 3,507,495 | A | 4/1970 | Tucker et al. |
| 3,591,178 | A | 7/1971 | Milligan et al. |
| 3,644,168 | A | 2/1972 | Bonk et al. |
| 3,702,702 | A | 11/1972 | Hoult |
| 3,822,062 | A | 7/1974 | Tucker et al. |
| D236,737 | S | 9/1975 | Brine |

(Continued)

FOREIGN PATENT DOCUMENTS

| | | |
|---|---|---|
| CA | 1273662 | 9/1990 |

OTHER PUBLICATIONS

STX Lacrosse Catalog 2000; Goalie Stick.
BRINE Catalog 2000; Goalie Stick.

*Primary Examiner*—Gregory Vidovich
*Assistant Examiner*—M. Chambers
(74) *Attorney, Agent, or Firm*—John S. Artz; Artz & Artz, PC

(57) ABSTRACT

A lacrosse goalie stick head (10) for attachment to a lacrosse stick. The lacrosse goalie stick head (10) comprises a traverse top wall (12) connected to a first sidewall (14) and a second sidewall (16). The first sidewall (14) has a first flange (36) and the second sidewall (16) has a second extending flange (38). The first and second sidewalls extend away from the top traverse wall (12), converge toward a base (19), and connect to the base (19). The base (19) has a throat portion 18 having a female end socket (23) for attachment to the lacrosse stick. The top traverse wall (12), the first sidewall (14), the second sidewall (16), and the base (19) form the lacrosse goalie stick head (10). The lacrosse goalie stick head (10) increases a goaltender's control in the deflection and receiving of lacrosse balls.

35 Claims, 2 Drawing Sheets

U.S. PATENT DOCUMENTS 3,905,088 A 9/1975 Tucker et al.
3,910,578 A 10/1975 Brine, Jr.
3,934,876 A 1/1976 Haddad
4,022,477 A 5/1977 Pool
4,034,984 A 7/1977 Crawford et al.
4,037,841 A 7/1977 Lewis, Jr.
4,049,273 A 9/1977 Pool
4,097,046 A 6/1978 Friant
D248,679 S 7/1978 Rule
4,138,111 A 2/1979 Rule
4,153,251 A 5/1979 Pond
D252,167 S 6/1979 Ahlenfeld et al.
4,206,918 A 6/1980 Lewis, Jr.
4,270,756 A 6/1981 Ahlenfeld et al.
D263,248 S 3/1982 Brine, Jr.
D263,249 S 3/1982 Rule
D265,845 S 8/1982 Brine, Jr. et al.
4,351,528 A 9/1982 Duplin
4,358,117 A 11/1982 Deutsch
RE31,419 E 10/1983 Frolow
D273,601 S 4/1984 Lewis, Jr. et al.
4,460,178 A 7/1984 Ulman
D277,691 S 2/1985 Rule
D286,666 S 11/1986 Brine, Jr.
D286,803 S 11/1986 Brine, Jr.
4,657,260 A * 4/1987 Brine, Jr. ..... 473/513
4,739,994 A 4/1988 Lewis, Jr.
D297,963 S 10/1988 Tucker et al.
4,861,042 A 8/1989 Trettin
4,938,480 A 7/1990 Lods
4,940,243 A 7/1990 Tucker et al.
5,007,652 A 4/1991 Tucker et al.
D318,509 S 7/1991 Naumburg, Jr.
5,035,434 A * 7/1991 Taylor et al. ..... 473/513
5,037,112 A 8/1991 Brine, III et al.
5,048,843 A 9/1991 Dorfi et al.
5,054,790 A 10/1991 Brine, III et al.
5,067,726 A 11/1991 Brine, III et al.
5,080,372 A 1/1992 Brine, III et al.
5,082,290 A 1/1992 Tucker et al.
D331,086 S 11/1992 Brine, III et al.
5,174,580 A 12/1992 Pratt
5,178,397 A 1/1993 Brine, Jr.
5,237,703 A 8/1993 Brine et al.
5,269,532 A 12/1993 Tucker et al.
5,290,039 A 3/1994 Cornelio
5,494,297 A 2/1996 MacNeil
5,566,947 A 10/1996 Tucker et al.
5,568,925 A 10/1996 Morrow et al.
D376,183 S 12/1996 Morrow et al.
5,651,744 A 7/1997 Millon et al.
5,935,026 A 8/1999 Dill et al.
6,283,879 B1 * 9/2001 Eden et al. ..... 473/513

* cited by examiner

LACROSSE GOALIE STICK HEAD

CROSS REFERENCE TO RELATED APPLICATION

The present invention claims priority from U.S. Provisional Application Ser. No. 60/197,720 filed Aug. 14, 2000 and entitled "LACROSSE GOALIE STICK".

TECHNICAL FIELD

The present invention relates generally to a lacrosse goalie stick head and, more particularly, to a lacrosse goalie stick head that allows for improved deflection and controlling of a lacrosse ball.

BACKGROUND OF THE INVENTION

Lacrosse goalie stick heads are well known in the game of lacrosse. Lacrosse goalie stick heads are used by goalies and are larger than the heads used by other players to assist in keeping the lacrosse ball out of the net the goalie is protecting. Current lacrosse goalie stick head designs typically take the form of an open frame having a top traverse wall, a base with a concave interior surface that defines a ball rest, and a pair of sidewalls that diverge from the base to the top traverse wall. The top traverse wall, the base, and the sidewalls are integrally formed into a unitary solid body or head frame. The base is integrally formed with a throat portion. The throat portion has a female end socket formed therein for receiving a conventional stick handle.

The head, base, and/or throat portion of current lacrosse goalie stick heads have holes therein for stringing lace therethrough to form netting on a backside of the head frame, as is known to one skilled in the art. A front side of the head frame has an open area to receive a lacrosse ball therein. The female end socket and the throat portion define a handle/head axis, which typically although not necessarily forms the central axis and/or an axis of lateral symmetry of the head. The central axis defines a plane through the center of the head. The plane lies parallel to the centerline of the lacrosse stick.

The sidewalls of current lacrosse goalie stick heads lie generally perpendicular to the axis and have a stiffening rib formed in the sidewalls to provide the requisite strength. The rib is typically formed at about the midpoint of the sidewall and only extends slightly outwardly from the sidewall. Additionally, some lacrosse goalie sticks have sidewalls that are angled slightly outward in an attempt to facilitate entry of the lacrosse ball into the head. Current non-goalie lacrosse heads are similar in configuration to current lacrosse goalie stick heads. The stiffening ribs of some non-goalie lacrosse heads also extend slightly outwardly from the plane of the lacrosse ball, however, they similarly are not intended to deflect or otherwise contact a lacrosse ball.

A lacrosse goalie in his/her role as defender of a lacrosse goal, has two main purposes, one is to prevent incoming lacrosse balls from entering the goal by catching and controlling them, and two, to deflect incoming balls that are not caught and prevent them from entering the goal. It would therefore be desirable to provide improvements to the goalie's lacrosse head that would increase the goalie's ability to successfully deflect or control the incoming lacrosse balls.

SUMMARY OF THE INVENTION

It is therefore an advantage of the present invention to provide a lacrosse goalie stick head that is configured to have a wider deflection area than traditional goalie heads thereby assisting a lacrosse goaltender in the deflection of lacrosse balls away from a goal.

It is a further advantage of the present invention to provide a lacrosse goalie stick head with the ability to assist a lacrosse goalie in the control of and guiding of a lacrosse ball into the open area of a head frame where it will be retained in the netting of the lacrosse goalie stick head.

It is another advantage of the present invention to provide a lacrosse goalie stick head with increased strength over conventional lacrosse goalie stick heads.

It is yet another advantage of the present invention to provide a lacrosse goalie stick head with increased surface area over current heads to improve the ability to block a lacrosse ball.

It is still another object of the present invention to provide a throat portion that can be easily gripped to allow a goalie to have more control over the cradling, catching, and passing of a lacrosse ball.

Accordingly, in accordance with the above and the other advantages of the present invention, a lacrosse goalie stick head is provided. The lacrosse goalie stick head has a traverse top wall, a first sidewall, a second sidewall opposing the first sidewall, and a base portion. The first sidewall and the second sidewall extend from the base portion and diverge from each other and are connected opposite the base portion to the traverse top wall. The traverse top wall, the first sidewall, the second sidewall, and the arcuate wall together form a head frame element. The base has a throat portion with a female end socket formed therein, which provides for attachment to a lacrosse stick handle. The head frame element and the base form the lacrosse goalie stick head. The lacrosse goalie stick head has a lateral center plane, spanning across the open area defined by the base. The sidewall adjacent the scoop lies at a slight forward angle with respect to the plane or the centerline of the throat portion. The first sidewall and the second sidewall have a flange that extends outwardly therefrom. The flanges are angled upwardly from their respective sidewalls to funnel deflected balls into the open area or deflect them away from a lacrosse goal.

These and other features and advantages of the present invention will become apparent from the following description of the invention, when viewed in accordance with the accompanying drawings and appended claims.

DETAILED DESCRIPTION OF THE PREFERRED EMBODIMENT

Figure 1:
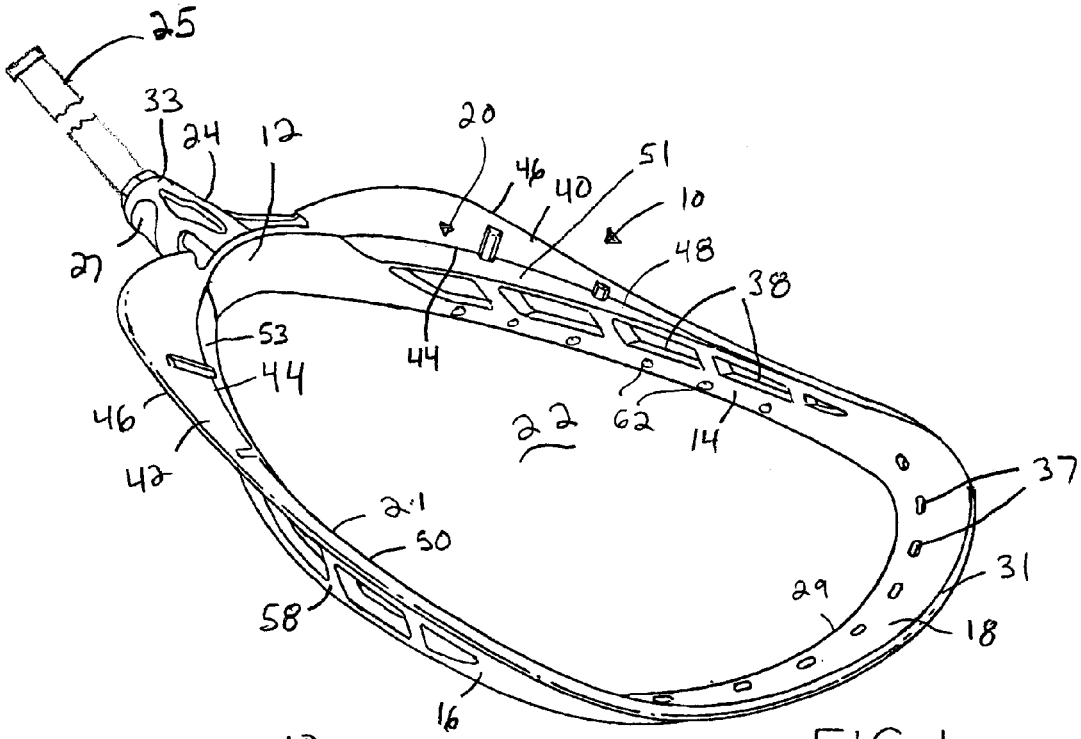
FIG. 1 is a top perspective view of a lacrosse goalie stick head in accordance with a preferred embodiment of the present invention.
Figure 2:
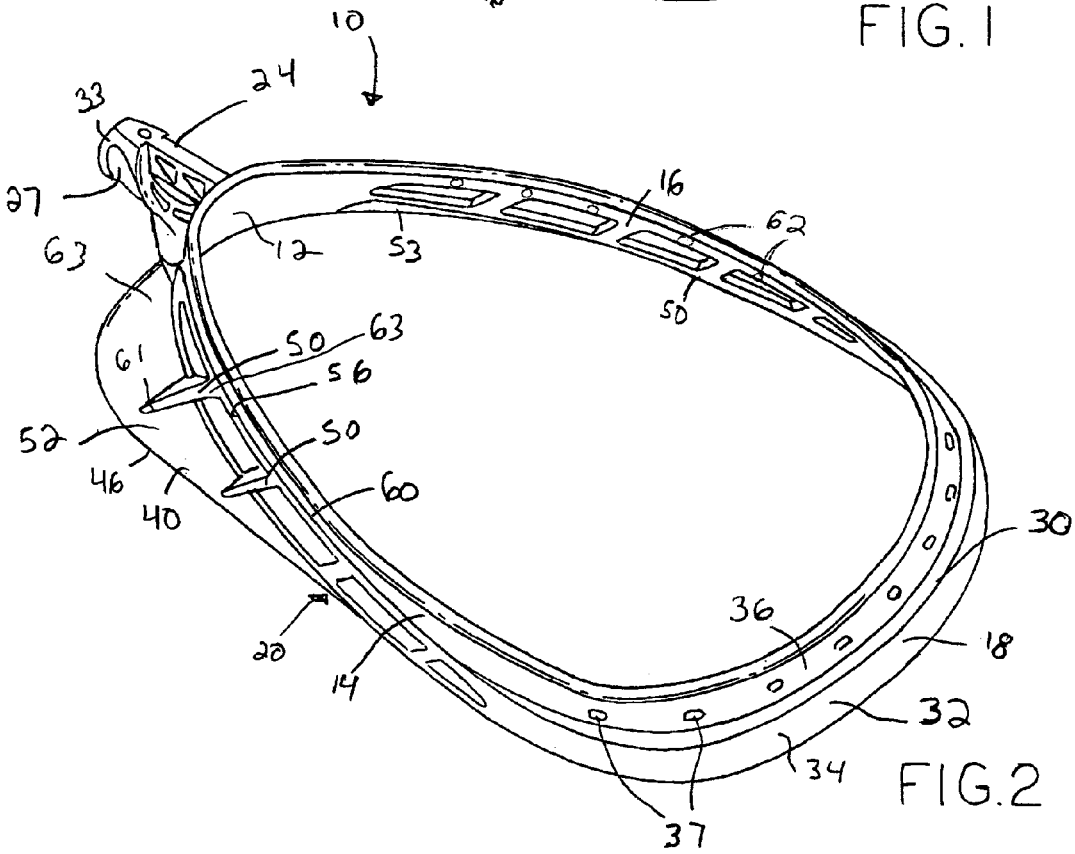
FIG. 2 is a bottom perspective view of a lacrosse goalie stick head in accordance with a preferred embodiment of the present invention.
Figure 3:
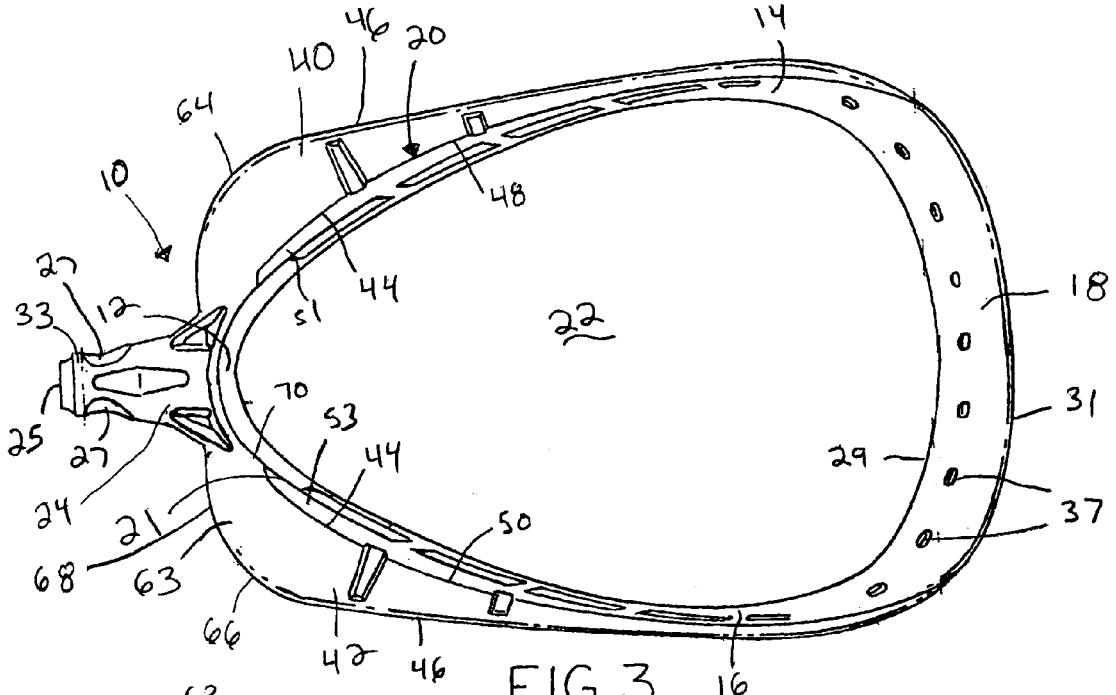
FIG. 3 is a top view of a lacrosse goalie stick head in accordance with a preferred embodiment of the present invention.
Figure 4:
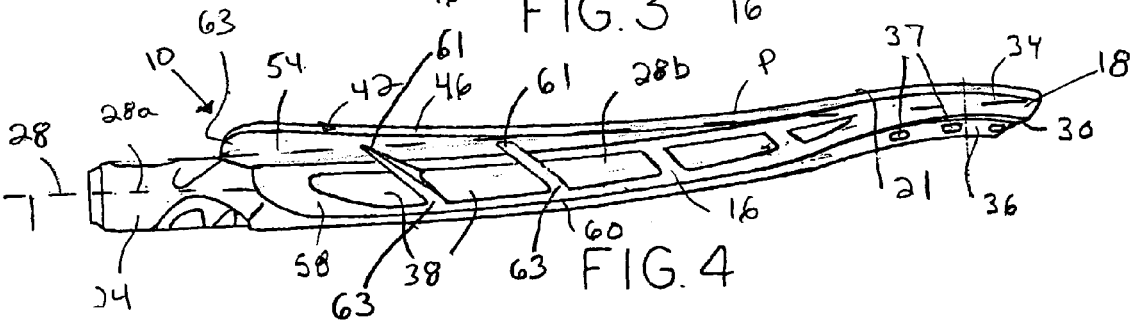
FIG. 4 is a side view of a lacrosse goalie stick head in accordance with a preferred embodiment of the present invention.
Figure 5:
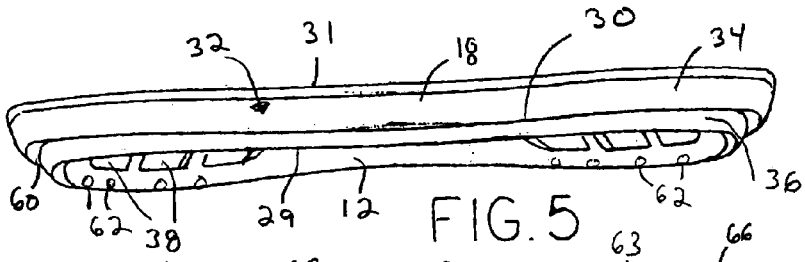
FIG. 5 is a front view of a lacrosse goalie stick head in accordance with a preferred embodiment of the present invention.
Figure 6:
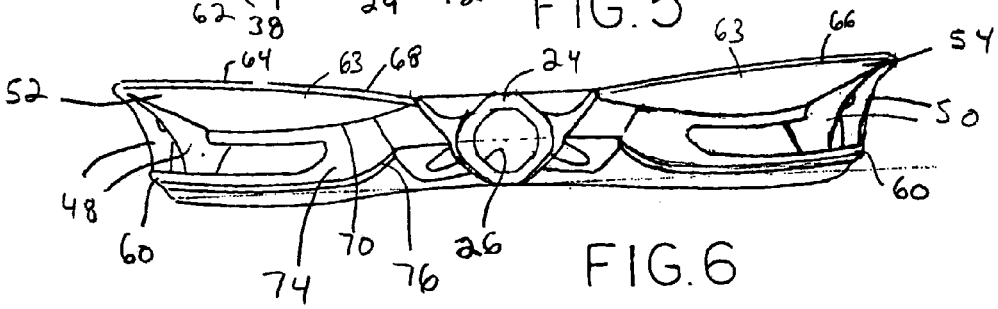
FIG. 6 is a rear view of a lacrosse goalie stick head in accordance with a preferred embodiment of the present invention.

Referring now to the figures which illustrate a lacrosse goalie stick head 10 in accordance with the present invention. The lacrosse goalie stick head 10 is preferably formed using an injection molding process, however, other processes such as structural foam molding or the like may also be utilized. The lacrosse goalie stick head 10 is preferably formed from a plastic material, however, other materials such as urethane, nylon, polyvinyl chloride, polyester, or a combination thereof may also be utilized.

Various directional terms, such as "top", "bottom", "upper", "lower", "outer", "forwardly", "inwardly", and "rear" are used herein to describe the head as illustrated in the drawings. However, it should be understood that these directional terms are not intended to be limiting and are only used for purposes of illustration.

As shown, the lacrosse goalie stick head 10 has a rear arcuate wall 12, a first sidewall 14, and a second sidewall 16 generally opposing the first sidewall 14. The first sidewall 14 and the second sidewall 16 each extend generally forwardly from the rear arcuate wall 12 and generally diverge from each other. The first sidewall 14 and the second sidewall 16 terminate at a top transverse wall or scoop 18. The rear accurate wall 12, the first sidewall 14, the second sidewall 16, and the scoop 18 together define a frame element 20. The upper portion or upper rim 21 of the frame element 20 defines an open area 22 into which a lacrosse ball can be received.

The frame element 20 has a throat portion 24 extending rearwardly therefrom. The throat portion 24 has a socket 26 formed therein for attachment to a lacrosse stick 25. The frame element 20 and the throat portion 24 are preferably integrally formed to define the lacrosse goalie stick head 10. The lacrosse goalie stick head 10 has a lateral plane P, spanning generally across the open area 22. The plane P is defined by an upper surface of the base 12 and extends across the frame element 20 to the scoop 18. The plane P is preferably oriented parallel to the centerline 28*a* of the throat portion 24 and the upper rims of the sidewalls 14, 16 curve such that they are forward of the plane P forwardly of the midpoint and preferably adjacent the scoop 18. This allows the lacrosse ball to be easily picked up by the goalie and also be passed with increased velocity over conventional heads.

The throat portion 24 is configured to allow a goalie to grip the throat portion 24 and maintain a firm grip without slipping. Specifically, the throat portion 24 has a pair of indentations or recesses 27 located on either side of the throat portion 24 to receive one or more of a goalie's fingers therein. Additionally, the most rearward end 33 of the throat portion 24 is enlarged or has an enlarged radius with respect to the rest of the throat portion 24 to help retain the user's hand thereon. This rearward end 33 can also be referred to as a butt end. By improving the goalie's grip, his/her ability to cradle is also improved.

The top traverse wall 18 is preferably outward sloping from its lower surface 29 to its upper surface 31 and is "scoop" or "shovel" shaped in order to assist in retrieving ground balls. A ridge 30 is formed as part of the outer side 32 of the scoop 18 to provide structural strength. The ridge 30 separates an upper portion 34 from a lower portion 36 of the top traverse wall 18. The material thickness of the top traverse wall 18 varies between the upper portion 34 and the lower portion 36, such that the upper portion 34 is thicker than the lower portion 36. The variance in wall thickness allows the top traverse wall 18 to flex inward, assisting in the control of the lacrosse ball, particularly when scooping up ground balls or in passing or shooting the ball. The top traverse wall 18 preferably has holes 37 or other means for a netting (not shown) to be attached to the head 10 such as through stringing. The holes 37 or other attachment means are preferably formed in the lower portion 36 of the scoop 18.

The first sidewall 14 and the second sidewall 16 have a plurality of slots or openings 38 formed therein, with trusses separating the slots 38. The plurality slots 38 may be of varying sizes and shapes, and may be formed in an injection molding process, a machining process, a drilling process, or a similar process as is known in the art. The plurality of openings 38 reduce the overall weight of the lacrosse goalie stick head 10. The overall weight of the head 10 can be varied simply by changing the size of the openings 38. The plurality of openings 38 also reduce the amount of air resistance or drag that will act on the lacrosse goalie stick head 10 as it is accelerating or mounting during use. One of the attributes that the reduction in weight and air resistance provides is improved user playability, such as increased shot speed and accuracy.

The first sidewall 14 and the second sidewall 16 each preferably have an outwardly extending flange 40, 42 that extends outwardly from each sidewall 14, 16. The extending flanges 40, 42 are preferably integrally formed with the frame element 20, and more preferably are integrally formed with a respective sidewall 14, 16. Each of the flanges 40, 42 has an inner peripheral edge 44 and an outer peripheral edge 46. The flanges 40, 42 extend between the inner peripheral edges 44 and the outer peripheral edges 46. The outer peripheral edges 46 preferably run at an angle with respect to the sidewalls 14, 16. It should be understood that the outer peripheral edges 46 as they travel towards the scoop 18 may converge towards or diverge away from each other. However, the outer peripheral edges 46 are preferably parallel to one another and terminate at one end at the throat portion 24 and at the other end at the scoop 18. The flanges 40, 42 preferably taper in width as they extend from the base 12 to the scoop 18 such that the outer periphery of the head 10 is generally rectangular in shape. The outer periphery of the head may take on a variety of different shapes.

The flanges 40, 42 preferably angle upwardly such that the outer edge 46 is raised with respect to the inner edge 44. The flanges 40, 42 may be curved or planar or take on a variety of other configurations between the outer edge 46 and the inner edge 44. Preferably, flanges 40, 42 are banked as they extend from one end to the other with the largest radius of curvature being generally in the middle. Further, the inner edge 44 of each flange 40, 42 preferably contacts the respective upper half of each sidewall 14, 16. More preferably each flange 40, 42 contacts its respective sidewall 12, 14 at or about its upper edge 48, 50. This configuration allows the flanges 40, 42 to assist in the guiding of a lacrosse ball into the open area 22 of the head frame 20. The upper portion 51, 53 of each sidewall 14, 16 is preferably generally sloped adjacent the inner edge 44 to provide additional slope to guide the ball into the open area 22 and the netting.

Additionally, the flanges 40, 42 are intended to deflect or block a lacrosse ball that is not caught in the open frame 22 and this prevents them from entering a lacrosse goal (not shown), without directing the ball into the open frame 20.

The flanges 40, 42 are configured such that the blocking area of the head 10 is increased. This is because the flanges 40, 42 significantly increase the contact area of the head with contact area being comprised of the open area 22, the frame element 20, and the flanges 40, 42. Although a constructed embodiment of the invention describes only two extending flanges, a plurality of extending flanges may be incorporated into the lacrosse goalie stick head 10 in various locations having various sizes, shapes, and configurations. The flanges 40, 42 also provide increased strength, rigidity, and stiffness to the frame element 20. The sizes of the flanges 40, 42 are not critical however, they must be sufficient in size to guide a ball into the open area and/or deflect a ball outwardly.

The first sidewall 14 and the second sidewall 16 further have a plurality of stiffening ribs 48, 50 formed thereon. Each of the ribs 48, 50 preferably extend outwardly from one or more of the trusses formed in each of the first and second sidewalls 14, 16 respectively and lie on the under surface 52, 54 of the respective flanges 40, 42. The plurality of ribs 48, 50 are preferably angled rearwardly towards the throat portion 24 and are tapered inwardly towards the open area 22 from its upper portion 61 to its lower portion 63. The plurality of ribs 48, 50 may be formed as mentioned above using an injection molding process or other suitable process. The plurality of ribs 48, 50 strengthen and provide increased stiffness and rigidity to the sidewalls 14, 16 and the flanges 40, 42. The plurality of ribs 48, 50 help support the respective flanges 40, 42. Additionally, the upper surface of each flange 40, 42 preferably has a depression formed adjacent the upper portion of each of the plurality of ribs 48, 50.

The outer surfaces 56, 58 of the first sidewall 14 and the second sidewall 16 each have a ridge 60 formed therein. The portion of the sidewalls 14, 16 above the ridge 60 is thicker than the portion of the sidewalls 14, 16 below the ridge 60. Further, the portion of the sidewalls 14, 16 below the ridge 60 is displaced inwardly when viewed from the outer surface 32. The ridge 60 in each sidewall 14, 16 is connected to either end of the ridge 30 formed in the scoop 18. The first sidewall 14 and the second sidewall 16 each preferably have a plurality of openings 62 formed therein to allow attachment of a netting thereto. Alternatively, other means of connecting netting to the head may also be utilized, including slots, clips, or the like. The plurality of openings 62 or other attachment means are preferably formed in the portion of the sidewalls 14, 16 below the ridge 60.

The base 12 is integrally formed with the first sidewall 14 and the second sidewall 16. The flanges 40, 42 have a rearwardly extending lip portion 63 that extends generally from the base 12. The rearwardly extending lip 63 is connected at one end 64 to the first flange 40 and at the other end 66 to the second flange 42. The rearwardly extending lip 63 is bisected by the throat portion 24. In other words, the rearwardly extending lip 63 is configured such that it terminates on either side of the throat portion 24. It should be understood that the lip 63 can take on a variety of configurations.

The rearwardly extending lip 63 also assists in the deflection and guiding of a lacrosse ball into the open area 22 or away from the goal. The rearward lip 63 has an outer edge 68 and an inner edge 70, with the outer edge 68 being raised with respect to the inner edge 70. The rearward lip 63 may be curved or planar or take on a variety of other configurations between the outer edge 68 and the inner edge 70. The inner edge 70 is preferably attached to the base 12 at or about its upper portion. However, the inner edge 70 may be attached to the base 12 at a variety of other locations along the base 12. The outer side 74 of the base 12 has a ridge 76 formed therein. It should be understood that the rearward lip 63 is preferably integrally formed with the flanges 40, 42. The rearward lip 63 may, however, take on a variety of different configurations.

The throat portion 24 may also have a means of lacing the lacrosse goalie stick head netting thereto, such as openings or the like. The openings may be formed in the base 12 or other portion of the throat. The openings or other attachment means are preferably formed in the base 12 below the ridge 76.

The first sidewall 14, the second sidewall 16, the first flange 40, and the second flange 42 together with their rearwardly extending lip portion 63 form an inward sloping structure around the open area 22 of the lacrosse goalie stick head 10. The inward sloping structure provides for increased deflection of balls with the necessary rigidity. The present invention provides increased control for a goaltender over incoming lacrosse balls and thereby increasing the goaltender's performance in defending a lacrosse goal. The inward sloping structure is preferably connected to the top surface of the sidewalls 12, 14 and has a portion located adjacent the upper surface of the throat portion 24. The flanges 40, 42 preferably extend approximately to the midpoint of the head 10. This allows the surface area of the head, which can contact a ball to be significantly increased without significantly increasing the size of the pocket.

The above-described apparatus and manufacturing method, to one skilled in the art, is capable of being adapted for various purposes and is not limited to the following applications: lacrosse goalie stick heads, lacrosse stick heads in general, and other similar heads used in other sporting activities. The above-described invention can also be varied without deviating from the true scope of the invention.

While particular embodiments of the invention have been shown and described, numerous variations or alternate embodiments will occur to those skilled in the art. Accordingly, it is intended that the invention be limited only in terms of the appended claims.

What is claimed is:

1. A lacrosse goalie stick head for attachment to a lacrosse stick, comprising:

a frame element including;

a rear arcuate wall;

a pair of opposing sidewalls extending generally outwardly from said rear arcuate wall; and a scoop located opposite said rear arcuate wall which connects said pair of opposing sidewalls;

said frame element defining an open area for receiving a lacrosse ball;

a throat portion connecting to and extending rearwardly from said rear arcuate wall, said throat portion having a socket formed therein for receipt of a lacrosse stick;

a plurality of net attachment structures formed in the goalie stick head for attachment of a netting thereto; and at least one flange extending generally outwardly away from said open area to assist in directing, said lacrosse ball into said open area, said at least one flange being attached to the lacrosse head adjacent an upper rim;

whereby said sidewalls are generally outwardly inclined adjacent said base to assist in directing said lacrosse ball into said open area.

2. A goalie stick head as recited in claim 1 wherein said flange is attached to said upper edge of said frame element.

3. A goalie stick head as recited in claim 1 wherein said traverse top wall, said pair of opposing sidewalls, said base, and said at least one flange are formed integrally as one unitary structure.

4. A goalie stick head as recited in claim 1 wherein said at least one flange is attached to a first sidewall of said pair of sidewalls and the head further comprises:

a second flange attached to a second sidewall of said pair of sidewalls.

5. A goalie stick head as recited in claim 4 wherein said first flange and said second flange each have a longitudinal edge on an outer periphery that diverge with respect to a centerline of said throat portion.

6. A goalie stick head as recited in claim 4, wherein said first flange and said second flange each have a longitudinal edge on an outer periphery that are configured such that said frame element has a generally rectangular periphery.

7. A goalie stick head as recited in claim 4 wherein said first sidewall and said second sidewall further comprise:

a plurality of slots; and a plurality of ribs, wherein each rib of said plurality of ribs is located between a pair of slots of said plurality of slots.

8. A goalie stick head as recited in claim 7 wherein said plurality of ribs attach to each of said first flange and said second flange.

9. A goalie stick head as recited in claim 7 wherein said plurality of slots and said plurality of ribs are formed integrally with the head frame.

10. A goalie stick head as recited in claim 4 wherein said first flange and said second flange have a rearward sloping lip portion that extends from said base portion, said rearward sloping lip intended to assist in guiding said lacrosse ball into said open area.

11. A goalie stick head as recited in claim 10 wherein said scoop, said first flange, said inward sloping lip, and said second flange form an inward sloping perimeter around said open area.

12. A goalie stick head as recited in claim 10 wherein said scoop is located forwardly of a plane defined by the upper surface of said base.

13. A goalie stick head as recited in claim 1, wherein said throat portion has at least one recess formed therein to accommodate a user's finger.

14. A goalie stick head as recited in claim 1 wherein the lacrosse goalie stick head further comprises:

an upper portion; and a lower portion, wherein said upper portion and said lower portion are integrally connected and form a ridge therebetween;

said ridge being continuous around the perimeter of an outer surface of said frame element.

15. A goalie stick head as recited in claim 1 wherein the lacrosse goalie stick head is formed by an injection molding process.

16. A goalie stick head as recited in claim 1 wherein the lacrosse goalie stick head is formed from one of the following urethane, nylon, polyvinyl chloride, polyester, or a plastic material.

17. A lacrosse goalie stick head for attachment to a lacrosse stick, comprising:

a frame element having a rear arcuate wall, a pair of opposing sidewalls extending generally outwardly from said rear arcuate wall, and a scoop located opposite said rear arcuate wall, which connects said pair of opposing sidewalls;

said frame element defining an open area for receiving a lacrosse ball, said open area having a generally spoon-like shape;

a throat portion connecting to and extending rearwardly from said rear arcuate wall, said throat portion having a socket formed therein for receipt of a lacrosse stick;

a plurality of net attachment locations formed in the goalie stick head for attachment of a netting thereto; and each of said pair of opposing sidewalls having at least one flange consisting of a surface extending generally outwardly away from said open area, each of said at least one flange having an outer surface that is raised with respect to an inner surface.

18. A goalie stick head as recited in claim 17 wherein said at least flange extends generally outwardly from one of said pair of opposing sidewalls, the head further comprises:

a second flange attached to a second sidewall of said pair of sidewalls.

19. A goalie stick head as recited in claim 17 wherein an outer surface of each of said first flange and said second flange diverges from a centerline of said throat portion.

20. The goalie stick head as recited in claim 17, wherein at least a portion of said at least one flange constitutes an inward lip that extends from said rear arcuate wall away from said open area.

21. The goalie stick head as recited in claim 20, wherein said inward lip has an outer surface that is raised with respect to said rear arcuate wall.

22. The goalie stick head as recited in claim 18 wherein at least one of said first flange or said second flange has a plurality of stiffening structures in contact with an underside of said flange.

23. The goalie stick head as recited in claim 17, wherein said at least one flange is planar between said inner surface and said outer surface.

24. The goalie stick head as recited in claim 17, wherein said at least one flange is curved between said inner surface and said outer surface.

25. The goalie stick head as recited in claim 17, wherein said throat portion has at least one recess formed therein for receipt of a user's finger.

26. A lacrosse goalie stick head, comprising:

a base;

a pair of sidewalls that extend from said base;

a scoop located opposite said base and connecting said pair of sidewalls;

said base, said pair of sidewalls, and said scoop define an open area therebetween for receiving a lacrosse ball;

a throat portion extending generally rearwardly from said base, said throat portion having a socket formed therein for receipt of a lacrosse stick; and each of said pair of sidewalls having an outwardly extending portion, which is intended to contact a lacrosse ball on its top surface;

an inwardly extending lip that extends from said base in a direction away from said open area.

27. The goalie stick head as recited in claim 26, wherein said outwardly portion is attached to an upper portion of each of said sidewalls.

28. The goalie stick head as recited in claim 26, wherein said outwardly extending portion is attached to an upper periphery of said at least one sidewall.

29. The goalie stick head as recited in claim 26, wherein said each of said outwardly extending portions is inclined such that an outer edge is raised with respect to an inner edge.

30. The goalie stick head as recited in claim 29, wherein each of said outwardly extending portions is planar between said outer edge and said inner edge.

31. The goalie stick head as recited in claim 29, wherein each of said outwardly extending portions is curved between said outer edge and said inner edge.

32. The goalie stick head as recited in claim 26, wherein each of said outwardly extending portions has an outer edge that is raised with respect to an upper periphery of each of said sidewalls.

33. The goalie stick head as recited in claim 26, wherein each of said outwardly extending portions has a plurality of support structures in contact with an underside thereof.

34. A lacrosse goalie stick head, comprising:

a base;

a pair of sidewalls that extend from said base;

a scoop located opposite said base and connecting said pair of sidewalls;

an open area for receiving a lacrosse ball being defined by said base, said pair of sidewalls, and said scoop;

a throat portion extending generally rearwardly from said base, said throat portion having a socket formed therein for receipt of a lacrosse stick; and an outwardly extending flange attached to a top surface of each of said sidewalls in order to significantly increase the blocking area of the lacrosse heads;

wherein said outwardly extending least one flange is generally planar between an inner surface located adjacent said open area and an outer surface located remote from said open area.

35. A lacrosse goalie stick head comprising:

a base;

a pair of sidewalls that extend from said base and connect to a scoop located opposite said base;

an open area for receiving a lacrosse ball being defined by said pair of sidewalls and said scoop;

said open area having a generally spoon-like shape;

a throat portion extending rearwardly from said rear arcuate wall for connection with a lacrosse handle;

each of said pair of opposing sidewalls having at least one flange extending generally outwardly from said open area adjacent an upper portion of each of said sidewalls;

and a plurality of support structures in contact with an underside of each of said at least one flange.

* * * * *